US008057269B2

(12) United States Patent
Ledermann et al.

(10) Patent No.: US 8,057,269 B2
(45) Date of Patent: Nov. 15, 2011

(54) CONTACT ELEMENT AND USE OF SUCH A CONTACT ELEMENT IN A PLUG CONNECTION

(75) Inventors: Tom Ledermann, Basel (CH); Reto Störi, Basel (CH); Roger Moll, Raedersdorf (FR)

(73) Assignee: Multi-Holding AG, Allschwil (CH)

( * ) Notice: Subject to any disclaimer, the term of this patent is extended or adjusted under 35 U.S.C. 154(b) by 38 days.

(21) Appl. No.: 12/525,134

(22) PCT Filed: Jun. 22, 2007

(86) PCT No.: PCT/CH2007/000313

§ 371 (c)(1),
(2), (4) Date: Jul. 30, 2009

(87) PCT Pub. No.: WO2008/092284

PCT Pub. Date: Aug. 7, 2008

(65) Prior Publication Data

US 2010/0093230 A1 Apr. 15, 2010

Related U.S. Application Data

(60) Provisional application No. 60/943,650, filed on Jun. 13, 2007.

(30) Foreign Application Priority Data

Jan. 31, 2007 (CH) ..... 0167/07

(51) Int. Cl.
*H01R 13/187* (2006.01)

(52) U.S. Cl. ..... 439/827; 439/843

(58) Field of Classification Search ..... 439/843, 439/927, 827, 844, 845; 174/355
See application file for complete search history.

(56) References Cited

U.S. PATENT DOCUMENTS

| | | | | | |
|---|---|---|---|---|---|
| 3,453,587 | A | | 7/1969 | Neidecker | |
| 4,082,411 | A | * | 4/1978 | Storck | 439/827 |
| 4,083,622 | A | * | 4/1978 | Neidecker | 439/86 |
| 4,106,839 | A | * | 8/1978 | Cooper | 439/607.18 |
| 4,120,557 | A | * | 10/1978 | Horrocks | 439/827 |
| 4,128,293 | A | * | 12/1978 | Paoli | 439/843 |
| 4,239,318 | A | * | 12/1980 | Schwartz | 439/607.18 |
| 4,456,325 | A | | 6/1984 | Benz | |
| 4,720,157 | A | * | 1/1988 | Nestor et al. | 439/851 |
| 4,725,251 | A | | 2/1988 | Neidecker et al. | |
| 4,786,262 | A | * | 11/1988 | Molitor et al. | 439/843 |
| 5,261,840 | A | * | 11/1993 | Benz | 439/843 |
| 5,445,542 | A | * | 8/1995 | Serizay | 439/607.17 |
| 5,523,527 | A | * | 6/1996 | Mann et al. | 174/366 |

(Continued)

FOREIGN PATENT DOCUMENTS

EP 0254770 A2 2/1988

(Continued)

*Primary Examiner* — Neil Abrams
(74) *Attorney, Agent, or Firm* — Browdy and Neimark, PLLC

(57) ABSTRACT

A contact element (10) comprises a spring-elastic carrier strip (11) extending in a longitudinal direction, and a plurality of web elements (17) having deformable feet (18), (19) that are disposed on the carrier strip (11) in the longitudinal carrier strip direction behind each other perpendicular to the carrier strip plane in a resilient manner in order to establish the electric contact between two opposing surfaces. A more compact design is achieved in that the web elements (17) are configured asymmetrically in relation to a center plane (M1) extending in the longitudinal carrier strip direction.

24 Claims, 8 Drawing Sheets

U.S. PATENT DOCUMENTS

| | | | | |
|---|---|---|---|---|
| 5,667,413 | A * | 9/1997 | Trafton | 439/843 |
| 5,957,465 | A * | 9/1999 | Gonsalves et al. | 174/354 |
| 6,062,919 | A * | 5/2000 | Trafton | 439/843 |
| 6,332,618 | B1 * | 12/2001 | Karlsson | 277/648 |
| 6,547,607 | B2 * | 4/2003 | Moll et al. | 439/816 |
| 6,783,406 | B2 * | 8/2004 | Keiser et al. | 439/827 |
| 2001/0019923 | A1 | 9/2001 | Moll | |

FOREIGN PATENT DOCUMENTS

| | | | |
|---|---|---|---|
| EP | 1119077 | A1 | 7/2001 |
| GB | 2398680 | A | 8/2004 |
| WO | 0057518 | A1 | 9/2000 |

* cited by examiner

CONTACT ELEMENT AND USE OF SUCH A CONTACT ELEMENT IN A PLUG CONNECTION

TECHNICAL FIELD

The present invention refers to the field of electrical connection technology. It relates to a contact element according to the preamble of claim 1 and to the use of such a contact element in a plug connection.

PRIOR ART

Contact elements in the form of contact lamellae have long been known and are used for the purpose of bridging relatively large gaps between two surfaces, which are to be electrically connected, in a reliable and permanent manner and with sufficiently high currents. Such contact elements and lamellae are based on a carrier strip on which a row of web elements, which project from the plane of the strip and can be pushed back into the plane of the strip in a sprung manner by torsion, are arranged one behind the other in the longitudinal direction of the carrier strip. In the case of the first contact lamellae, the web elements which established contact were formed directly from the strip material of the carrier strip by a stamping/bending process (see, for example, U.S. Pat. No. 3,453,587). These contact lamellae are accordingly single-component contact elements.

These contact elements had the disadvantage not only of restricted geometric dimensioning of the web elements which were formed from the carrier strip itself by stamping, but also of restricted selection of the carrier strip material which had to have both good spring characteristics and good electrical conduction and contact-making properties.

Therefore, it was later proposed to provide the carrier strip and web elements as separate parts (two-component contact elements), so that the spring function of the carrier strip could be optimized while the electrical characteristics of the web elements, which are attached to the carrier strip, were optimized. At the same time, it was possible to bridge relatively large contact distances due to the increased level of freedom in terms of dimensioning of the web elements. Contact elements or contact lamellae of this type are known, for example, from U.S. Pat. No. 4,456,325 and from EP-A2-0 254 770 or from EP-A1-1 119 077.

In the last-mentioned document (EP-A1-1 119 077), contact clips which are bent to form a V are used as web elements, these contact clips being equipped with clamping feet at the free ends and being attached to the carrier strip. On the lower face, the clamping feet make electrical contact with one contact area by means of a contact point in each case. The tip of the contact clip makes contact with the other, opposite contact area at a further contact point. That limb of the contact clip which is at the front in the plugging direction serves to allow the contact clip to be compressed in a gently sliding manner in the direction of the carrier strip when the plug connection is inserted. That limb of the contact clip which is at the rear in the plugging direction does not have a comparable function. However, it does increase the width of the contact element, and this is disadvantageous with regard to compactness.

SUMMARY OF THE INVENTION

The object of the invention is therefore to provide a contact element in the form of a contact lamella, which has the advantages of the two-component contact elements and at the same time can be of more compact construction or transmits more current with smaller external dimensions.

The object is achieved by all of the features of claim 1. It is essential to the invention that the individual web elements which establish the electrical contact are formed in an asymmetrical manner relative to a center plane which runs in the longitudinal direction of the carrier strip. As a result, it is possible to considerably increase the number of contact points per unit length with a smaller width.

One embodiment of the invention is distinguished in that the web elements each have two clamping feet which are spaced apart from one another transverse to the longitudinal direction of the carrier strip and by means of which said web elements are attached to the carrier strip, and by means of which said web elements make electrical contact with one of the two opposite surfaces, and in that the web elements each have a triangular contact fin which is connected to the clamping feet and of which the fin tip is arranged on one side of the center plane and makes electrical contact with the other of the two opposite surfaces.

In particular, the carrier strip for the web elements which are arranged one behind the other in the longitudinal direction of the carrier strip has, in each case, two spring arms which project transverse to opposite directions from a web which extends in the longitudinal direction of the carrier strip, and which act as torsion springs, and which have attached to their free ends the respective web element by means of its clamping feet, wherein the web elements which are arranged one behind the other in the longitudinal direction of the carrier strip are arranged so as to overlap.

The contact fins preferably essentially have the shape of a right-angled triangle in which the clamping feet are arranged at the ends of a leg, and the fin tip is formed by the other leg and the hypotenuse.

Another embodiment is characterized in that, in the region of the clamping feet, the web elements in each case surround the carrier strip or the spring arms by way of a contact lug in a clamping manner.

In addition to clamping-type attachment of the web elements on the carrier strip or the spring arms, an interlocking connection can be provided between the carrier strip or the spring arms and the clamping feet, wherein, in order to establish the interlocking connection, holes are made in the carrier strip or the spring arms, the clamping feet engaging in said holes by way of a corresponding embossment.

In order to facilitate installation, guide lugs which protrude laterally beyond the clamping feet can be integrally formed at the free ends of the spring arms.

A guide lug is preferably integrally formed at the free end of an individual spring arm, said guide lug protruding laterally beyond a clamping foot preferably only on one side.

A further embodiment of the invention is distinguished in that the contact element has only one row of web elements which are arranged one behind the other in the longitudinal direction of the carrier strip, and the associated carrier strip correspondingly comprises only one web, which extends in the longitudinal direction of the carrier strip and runs in the center of the carrier strip, having two spring arms which project transversely in opposite directions and act as torsion springs.

The density of the contact points can be increased when the contact element has two parallel rows of web elements which are arranged one behind the other in the longitudinal direction of the carrier strip, when the associated carrier strip correspondingly comprises two webs which extend in parallel in the longitudinal direction of the carrier strip and in each case have two spring arms which project from said webs transversely in opposite directions and act as torsion springs, and when the spring arms which project inward from the two webs are connected to one another in pairs at the ends by means of a central connection. In this case, it is particularly advantageous for the central connection to be designed such that the web element which is in each case at the rear in the plugging direction is precompressed during the plugging process and independently establishes electrical contact between the two opposite surfaces in the fully plugged-in state.

In particular, the web elements of the two parallel rows are designed and arranged so as to form a mirror image with respect to a center plane which is situated between the rows.

It is particularly expedient when the web elements each have two clamping feet which are spaced apart from one another transverse to the longitudinal direction of the carrier strip and by means of which said web elements are attached to the carrier strip, and by means of which said web elements make electrical contact with one of the two opposite surfaces, and when the web elements each have triangular contact fins which are connected to the clamping feet and of which the fin tips are arranged on both sides and in the immediate vicinity of the center plane which is situated between the rows and make electrical contact with the other of the two opposite surfaces.

The use of the contact element in a plug connection which comprises a plug and a socket is characterized in that the contact element is arranged in a recess on the outside of the plug or on the inside of the socket in such a way that the fin tip is arranged at the rear in the plugging direction.

When the contact element has guide lugs which protrude transversely outward, said contact element is advantageously guided in lateral undercuts in the recess by the guide lugs.

A further preferred use of the contact element is characterized in that the contact element has guide lugs which protrude transversely outward. In this case, the guide lugs protrude beyond the web elements, preferably on one side. The contact element is guided in a single lateral undercut in the recess by the guide lug. In this case, the guide lugs are arranged in a row, wherein the row of guide lugs projects into the undercut.

BRIEF DESCRIPTION OF THE FIGURES

The invention will be explained in greater detail below with reference to exemplary embodiments in conjunction with the drawing, in which.

WAYS OF IMPLEMENTING THE INVENTION

Figure 1:
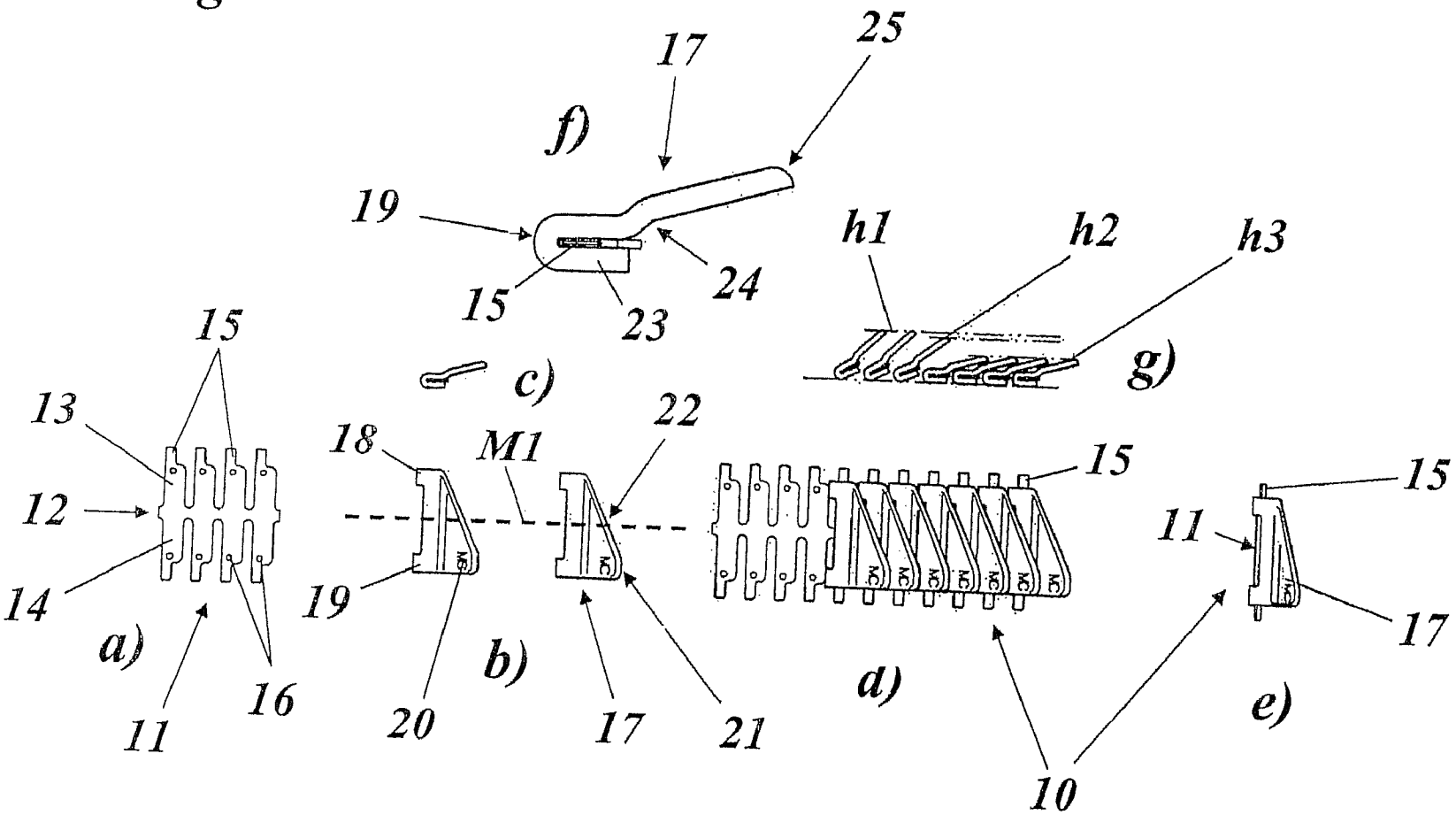
FIG. 1 shows, in various subfigures 1(*a*) to 1(*g*), various details and views of a contact element with only one row of asymmetrical web elements according to a first exemplary embodiment of the invention.

FIG. 1 illustrates, in various subfigures 1(*a*) to 1(*g*), various details and views of a contact element with only one row of asymmetrical web elements according to a first exemplary embodiment of the invention. The contact element 10 comprises a spring-elastic carrier strip 11, which extends in a longitudinal direction and is composed of a suitable metal sheet, and a plurality of web elements 17 (FIG. 1(*g*)), which are arranged one behind the other in the longitudinal direction of the carrier strip and are attached to the carrier strip 11 in a resilient compressable manner perpendicular to the plane of the carrier strip, for establishing electrical contact between two opposite surfaces (26, 27 or 46, 47 in FIG. 9).

Figure 9:
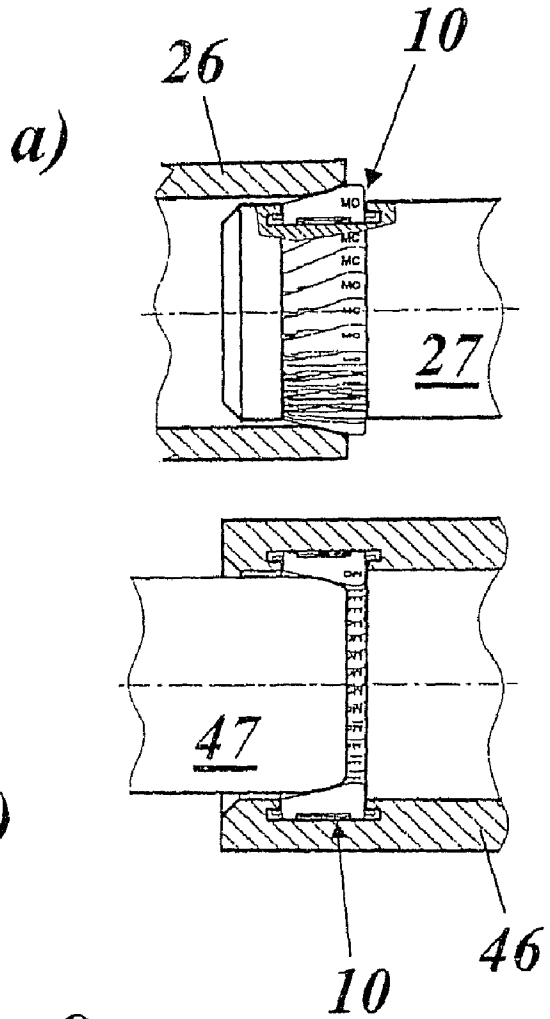
FIG. 9 shows, in two subfigures 9(*a*), 9(*b*), the plugging process for a plug connection which is equipped with the contact element according to FIG. 1, wherein the contact element is arranged on the plug (9*a*) or in the socket (9*b*)

The web elements 17, which are composed of a highly electrically conductive material (for example Cu) and are preferably surface-treated (for example silver-plated), are formed in an asymmetrical manner relative to a center plane M1 (FIG. 1(*b*)) which runs in the longitudinal direction of the carrier strip. Said web elements each have two clamping feet 18, 19 which are spaced apart from one another transverse to the longitudinal direction of the carrier strip and by means of which said web elements are attached to the carrier strip 11, and by means of which said web elements make electrical contact with one of the two opposite surfaces 26, 27 or 46, 47 (FIG. 9).

The web elements 17 each have a triangular contact fin 20 which is connected to the clamping feet 18, 19 and of which the fin tip 21 is arranged on one side of the center plane M1 (FIG. 1(*b*)) and makes electrical contact with the other of the two opposite surfaces 26, 27 or 46, 47. The triangular shape of the contact fin 20 gives the web elements 17 the desired asymmetrical form. The incline 22 which runs from the fin tip 21 to a clamping foot 18 leads to gentle compression of the web elements 17 when the contact element according to FIG. 9 is installed in a plug connection 26, 27 or 46, 47.

The spring behavior of the web elements is achieved by the carrier strip 11 for the web elements 17 having, in each case, two spring arms 13, 14 which project transverse to opposite directions from a web 12 which extends in the longitudinal direction of the carrier strip, and which act as torsion springs, and which have attached to their free ends the respective web element 17 by means of its clamping feet 18, 19. The spring arms 13, 14 (height h1 in FIG. 1(*g*)), which is the slightly twisted in the relaxed state, are arranged so closely one behind the other in the longitudinal direction of the carrier strip that the web elements 17 exhibit a high degree of overlap and thus provide a high level of contact and current density per unit length of the contact element. According to FIG. 1(*g*), the contact element 10 can compensate for a maximum height h2 between two surfaces between which contact is to be made; the minimum height h3 is achieved when the web elements 17 are situated one above the other in the manner of scales.

In order to construct the contact element 10, the individual web elements 17 (FIG. 1(*b*)) are attached to the prepared carrier strip 11 (FIG. 1(*a*)) by the spring arms 13, 14 being clamped in in the region of the clamping feet 18, 19 by bending over a contact lug 23 (FIG. 1(*f*)). The clamping establishes a force-fitting connection between the carrier strip 11 and the web elements 17. In addition to clamping-type attachment of the web elements 17 to the carrier strip 11 or the spring arms 13, 14, an interlocking connection can be provided between the carrier strip 11 or the spring arms 13, 14 and the clamping feet 18, 19. This can be achieved by holes 16 being made in the carrier strip 11 or the spring arms 13, 14 at the appropriate points, the clamping feet 18, 19 engaging in said holes by way of a corresponding embossment of the contact lugs 23. This embossment is not illustrated in the drawing. Other types of interlocking connection are likewise feasible.

Figure 2:
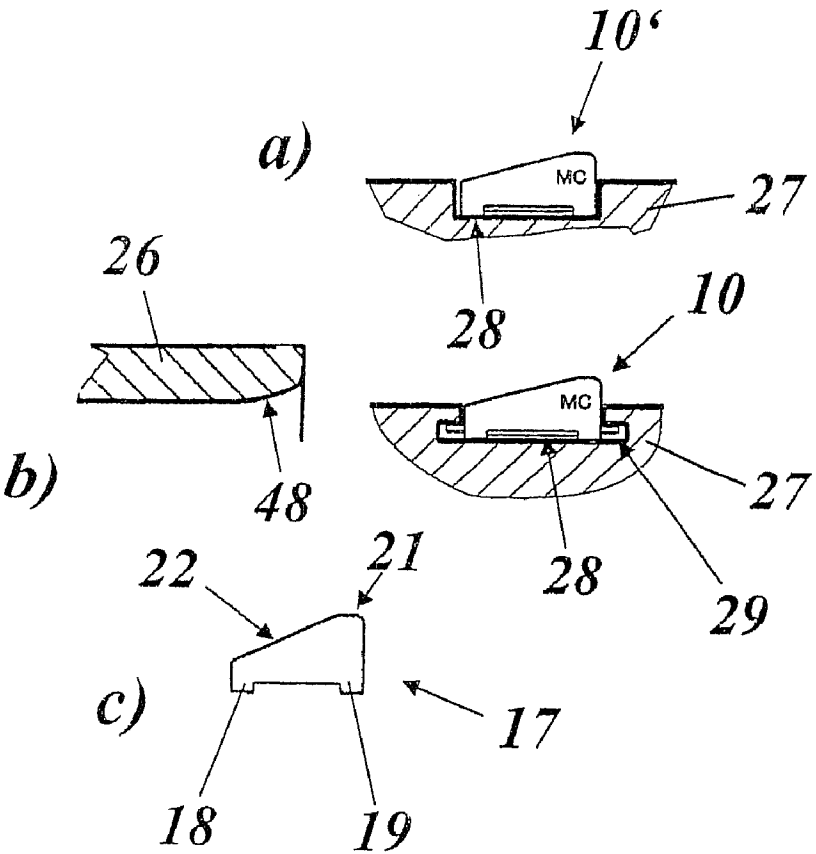
FIG. 2 shows, in various subfigures 2(*a*) to 2(*c*), the installation of the contact element according to FIG. 1 with and without lateral guide lugs.

In order for the contact element 10 to be reliably held at the site of installation (FIG. 2(*b*); FIG. 9), guide lugs 15 which protrude laterally beyond the clamping feet 18, 19 can be integrally formed at the free ends of the spring arms 13, 14. When the contact element 10 is arranged in a recess 28 on the outside of the plug or on the inside of the socket 46, said contact element is guided in lateral undercuts 29 in the recess by the guide lugs 15 (FIGS. 2, 9). However, in accordance with FIG. 3, a contact element 10' without lateral guide lugs is also feasible, said contact element, in accordance with FIG. 2(*a*), when slightly installed in a socket, being inserted into a simple recess 28 without an undercount.

However, instead of the asymmetrical single-web variant of FIGS. 1 to 3 and 9, the invention can also cover an asymmetrical two-web variant according to FIGS. 4 to 8 and 10. As a result, the number of contact points is doubled. In this case, the carrier strip 31 (FIG. 4(*a*)) of the contact element 30 virtually comprises two carrier strips 11, which run in parallel, according to FIG. 1(*a*) having webs 32, 32' and spring arms 34, 34' or 35, 35' which project from the webs and in which the spring arms 34', 35' which project inward from the two webs 32, 32' are connected to one another in pairs at the ends by means of a central connection 33 which is situated in a center plane M3.

Figure 4:
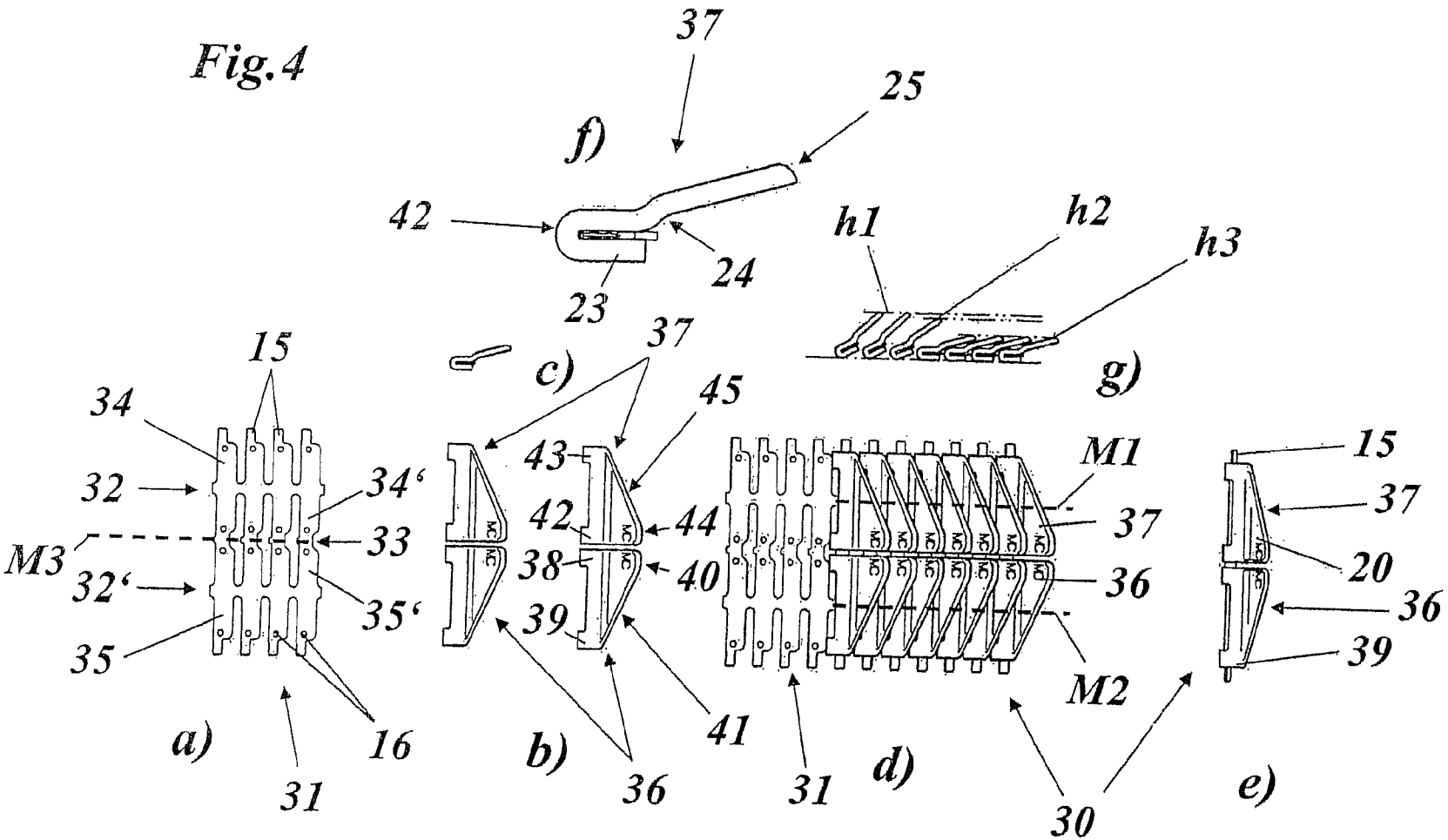
FIG. 4 shows, in various subfigures 4(*a*) to 4(*g*), various details and views of a contact element with two parallel rows of asymmetrical web elements according to a second exemplary embodiment of the invention.

Two parallel rows of web elements 36, 37 which are arranged one behind the other in the longitudinal direction of the carrier strip are provided in the case of contact element 30, each web element having two clamping feet 38, 39 or 42, 43 which are spaced apart from one another transverse to the longitudinal direction of the carrier strip (FIG. 4(*b*)) and by means of which said web elements are attached to the carrier strip 31, and by means of which said web elements make electrical contact with one of the two opposite surfaces at two contact points. The web elements 36, 37 of the two parallel rows are designed and arranged so as to form a mirror image with respect to a center plane M3 which is situated between the rows.

The web elements 36, 37 each have triangular contact fins 20 which are connected to the clamping feet 38, 39 or 42, 43 and of which the fin tips 40, 44 are arranged on both sides and in the immediate vicinity of the center plane M3 which is situated between the rows and make electrical contact with the other of the two opposite surfaces with in each case one contact point. The contact fins 20 preferably essentially have the shape of a right-angled triangle in which the clamping feet 38, 39 or 42, 43 are arranged at the ends of a leg of the triangle, and the fin tip 40 or 44 is formed by the other leg and the hypotenuse. The contact fins 20 of the two adjacent web elements 38, 39 are arranged so as to form a mirror image with respect to one another, wherein the center plane M3 acts as the mirror plane.

Figure 7:
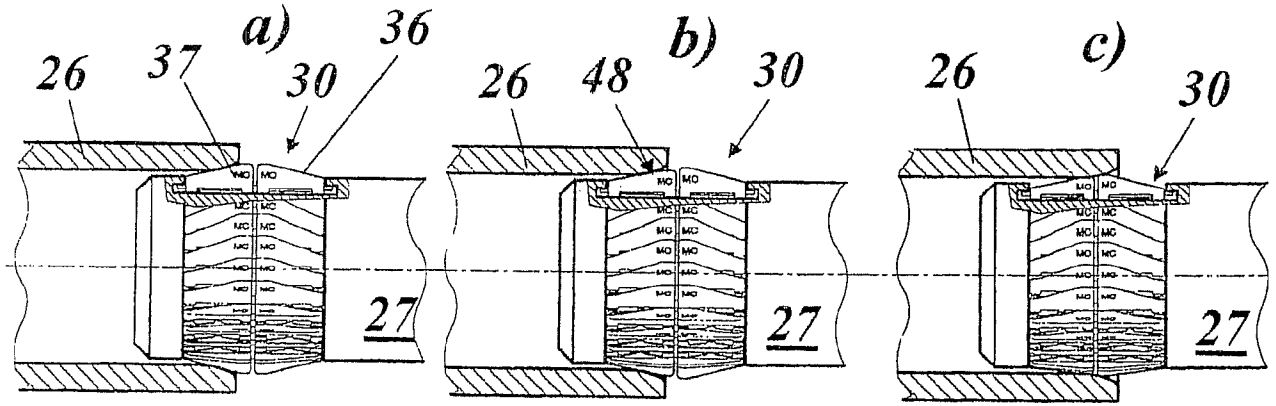
FIG. 7 shows, in several subfigures 7(*a*) to 7(*c*), the plugging process for a plug connection which is equipped with the contact element according to FIG. 4, wherein the contact element is arranged on the plug.
Figure 8:
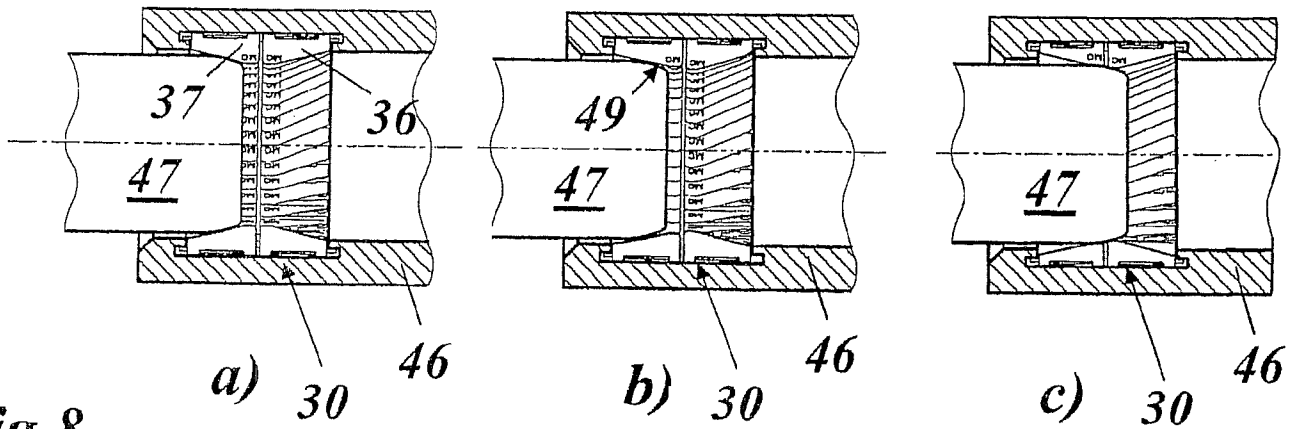
FIG. 8 shows, in several subfigures 8(*a*) to 8(*c*), the plugging process for a plug connection which is equipped with the contact element according to FIG. 4, wherein the contact element is arranged in the socket.

As can be seen in FIG. 1(*f*) and (e) and FIG. 4(*f*) and (*e*), the web elements 17 or 36, 37 have a rounded portion 25 along the incline 22 or 41, 45 and the fin tip 21 or 40, 44. This rounded portion facilitates pivoting of the web elements 17 or 36, 37 during resilient compression in the course of the plugging process (FIGS. 7-9). The plugging process is additionally facilitated by a rounded portion 48 or 49 on the contact piece of the plug connection, one edge of said contact piece sliding along the incline of the front web elements during insertion.

The special feature of the web elements 36, 37 which interact by means of the common carrier strip 31 in the case of contact element 30 of FIG. 4 can be seen in FIGS. 7 and 8 which show the insertion process for a plug connection with the contact element 31: the two springs are coupled on account of the mechanical connection of the spring arms 34' and 35', which act as torsion springs and are directed inward, in the center plane M3 (central connection 33). During insertion, the front web elements of the contact element 31 are first pivoted toward the carrier strip such that they are resiliently compressed (FIG. 7(*a*)->7(*b*) or FIG. 8(*a*)->8(*b*)). By virtue of the central connection 33, this pivoting movement is at least partially transmitted to the adjacent web element which is respectively to the rear and is likewise compressed. As a result, the contact piece (26 in FIG. 7; 47 in FIG. 8) which is moved relative to the contact element can slide over the fin tip of the rear web elements without any problem.

Figure 10:
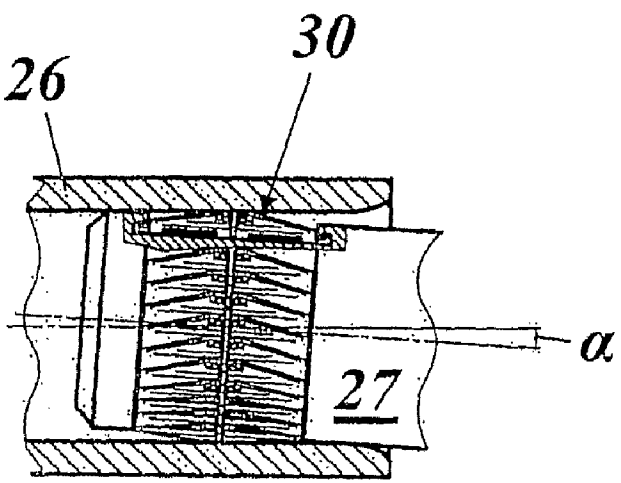
FIG. 10 shows the tolerable angular deviation ($\alpha$) in a plug connection according to FIG. 7.

A further advantage of the fin tips, which are moved into the center, of the asymmetrical web elements is clear from FIG. 10: a greater angular deviation between the contact pieces (angle $\alpha$) can be tolerated during insertion.

Figure 3:
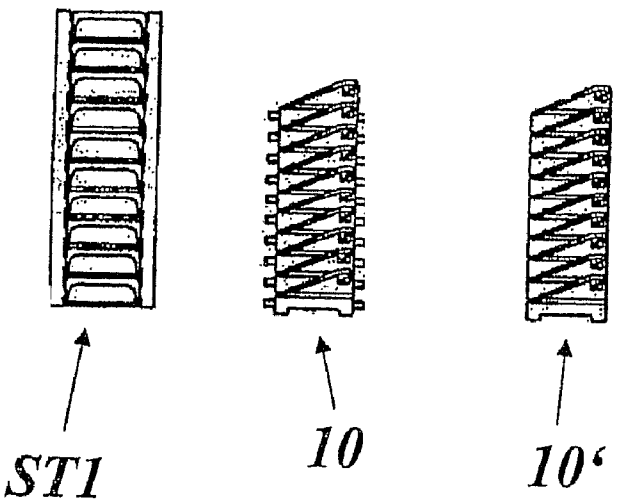
FIG. 3 shows the comparison of the contact elements according to FIG. 2 with a contact element from the prior art.

Comparison of the contact elements 10 or 10' with a known contact element ST1 of the LA-CU type from the same applicant in FIG. 3 shows that (with an approximately identical width) substantially more contact points per unit length, and therefore a greater current density, can be achieved with the solution according to the application.

Figure 6:
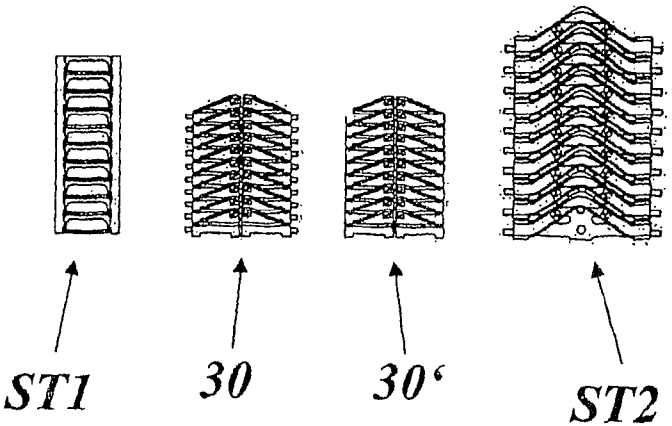
FIG. 6 shows the comparison of the contact elements according to FIG. 4 with two contact elements from the prior art.
Figure 5:
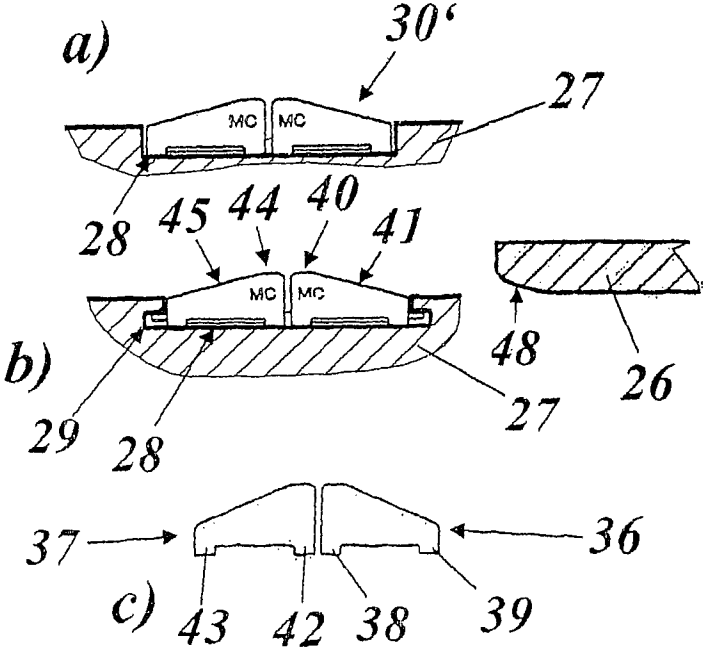
FIG. 5 shows, in various subfigures 5(*a*) to 5(*c*), the installation of the contact element according to FIG. 4 with and without lateral guide lugs.

Comparison of the contact elements 30 or 30' with the known contact element ST1 of the LA-CU type from the same applicant and the contact element ST2 known from EP-A1-1 119 077 in FIG. 6 shows that (given a reduced width in comparison to ST2) substantially more contact points per unit length, and therefore a greater current density, can be achieved with the solution according to the application. In contrast to ST1, the width is somewhat smaller and the number of contact points per unit length is considerably higher.

The following can be stated in summary:

The novel contact element for electrically contact-connecting two conductive metallic surfaces is distinguished in that two components, which are produced from two different materials, are individually responsible for mechanical and electrical properties.

The special geometry of the contact element ensures that both electrical properties and tolerance allowance over existing contact elements are considerably improved in a small space.

In this case, there are two variants of the contact element:

The asymmetrical single-web variant is distinguished in that the upper contact point to the mating piece is not in the center of the strip width of the carrier strip, as a result of which a larger working area in a small space is achieved.

The symmetrical double-web variant is characterized in that two asymmetrical web elements with the same geometry as in the case of the single-web variant are mounted next to one another on a sprung strip so as to be inclined relative to one another, in that the two upper contact points to the mating piece are situated in the center of the strip width of the carrier strip, and in that the two web elements are individually sprung and at the same time have a great enough influence, on account of coupling by means of the central connection, to ensure harmonic compression of the side (plugging).

The novel contact element is distinguished by the following characteristic properties and advantages.

Optimized mechanical and electrical properties due to separation into a sprung carrier strip and conductive web element.

Small grid pattern due to sophisticated, stackable geometry of the web elements or contact clips.

Reasonably large working area for compensating large tolerances and angular deviations.

In the case of the double-web variant, the two web elements which are inclined with respect to one another permit an even greater angular deviation than in the case of two elements of the individual web variant.

Optimized ratio of working area to width.

Three-point contact (two contact points at the bottom, one at the top) on each individual web element.

Small width due to a central rotary joint.

Greatly increased current density, particularly in the case of the double-web variant.

Improved installation options.

Installation in sockets and plugs possible.

Attachment of the upper contact point to the mating piece on one side (instead of in the center) of the web element or contact clip increases the working area with a lower width, resulting in optimized ratio of working area and width with no change in the gradient of the contact web.

The geometry of the web elements or contact clips allows them to be stacked. As a result, a smaller grid pattern is possible.

In the case of the double-web variant, the two contact points in the center of the strip width permit optimized angular tolerance allowance.

In the case of the double-web variant, the central connection of the two rotary joints ensures that the second web element is precompressed by the first web element from one side (plugging) during the compression process. This ensures a harmonious, smooth insertion process.

At the same time, in the case of the double-web variant, the two web elements are independent enough to guarantee two upper contact points. As a result, the contact and therefore current density is greatly increased.

Figure 11:
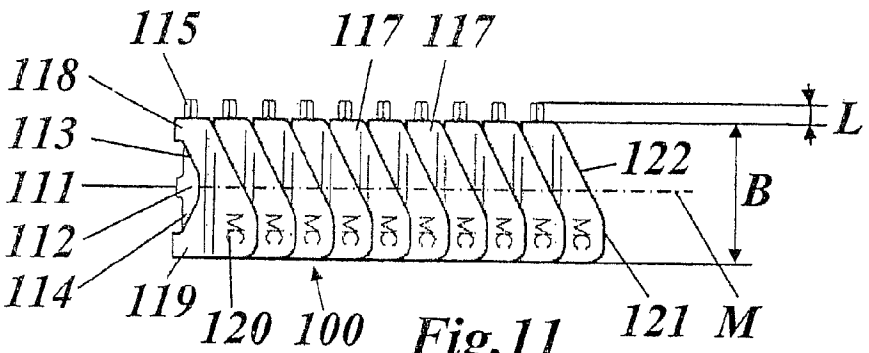
FIG. 11 shows a view of a contact element with only one row of asymmetrical web elements according to a third exemplary embodiment of the invention.

A third embodiment of a contact element, to which the abovementioned advantages also apply, is illustrated in FIG. 11. Identical parts are provided with identical reference symbols. Furthermore, features or subfeatures of the exemplary embodiments already mentioned can be combined with the following exemplary embodiments as desired to form further variants.

The third exemplary embodiment of the contact element 100, which exemplary embodiment is shown in FIG. 11, essentially comprises a carrier strip 111 and a plurality of web elements 117 which project from the carrier strip. The carrier strip 111 and the web elements 117 are essentially analogous to the exemplary embodiment already described above.

The contact element 100 accordingly comprises a spring-elastic carrier strip 111, which extends in a longitudinal direction, and a plurality of web elements 117, which are arranged one behind the other in the longitudinal direction of the carrier strip and are attached to the carrier strip in a resilient manner perpendicular to the plane of the carrier strip, for establishing electrical contact between two opposite surfaces. A guide lug 115 is preferably integrally formed at the free end of an individual spring arm 113, said guide lug protruding laterally beyond a clamping foot 118 of the web element 117, preferably only on one side.

The guide lug 115 which is integrally formed on one side can, with the described features, represent an invention which is independent of the other cited features (in particular of the asymmetrical design of the web elements).

As an alternative, it can also be said that, in the third exemplary embodiment, the length of the guide lugs 115 is different from the length of the guide lugs of the preceding exemplary embodiments. The guide lugs 115 are, as described above, integrally formed on the free ends of the spring arms. In this case, the guide lugs 115, which protrude from a first side of the carrier strip 111, are longer than the guide lugs which protrude from a second side of the carrier strip 111. The first side is, for example, the side which is on the right of the center axis M of the carrier strip 111, wherein the second side in this case is the side which is on the left of the center axis M.

The web elements 117 are preferably arranged on the carrier strip 111 in such a way that the incline 122 faces the longer guide lug 115, and that the fin tip 121 faces the shorter guide lug. In other words, the longer guide lug 115 on the side of the incline 122 protrudes beyond the width B of the web element 117 essentially perpendicular to the center axis M. In other words, it can also be said that the guide lug 115 which is integrally formed at the free end of the spring arm 113 extends so as to protrude laterally beyond the clamping foot 118.

As an alternative, the web elements 117 can also be arranged in reverse, so that the longer guide lug 115 protrudes on the side of the fin tip 121.

The length of the shorter guide lug is preferably configured in such a way that it does not protrude beyond the width B of the web elements 117. As an alternative, the arrangement of the shorter guide lug can also be dispensed with or the shorter guide lug 115 can have a length such that it extends beyond the width B of the web elements 117. In the latter case, the guide lug would accordingly extend on both sides.

It can be said in general that the longer guide lug protrudes beyond the width B of the web element 117 at least on one side of the contact element. As a result, the maximum width of the contact element 100 is increased by the protruding length L of the longer guide element 115. The maximum width of the contact element is accordingly made up of the width B of the web element 117 and the protruding length L of the guide element 115.

Figure 12B:
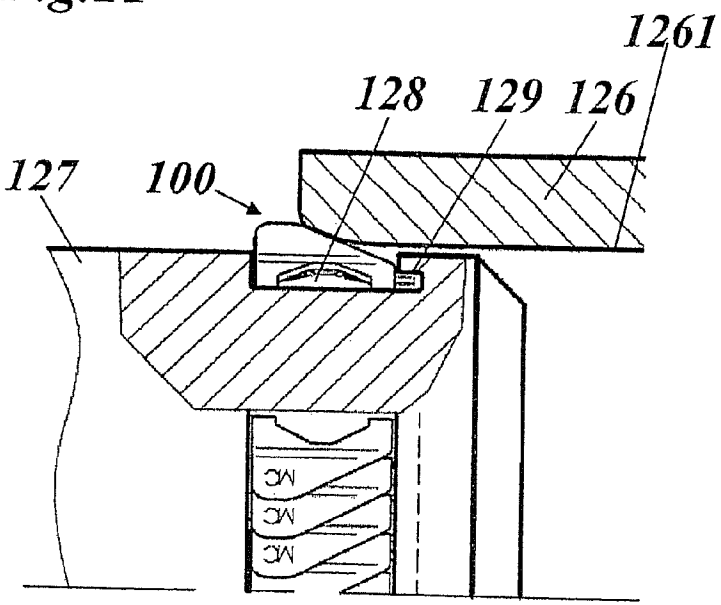
FIG. 12 shows, in two subfigures 12(*a*) and 12(*b*), various details and views of a contact element, which is or is to be installed, in a plug.
Figure 12A:
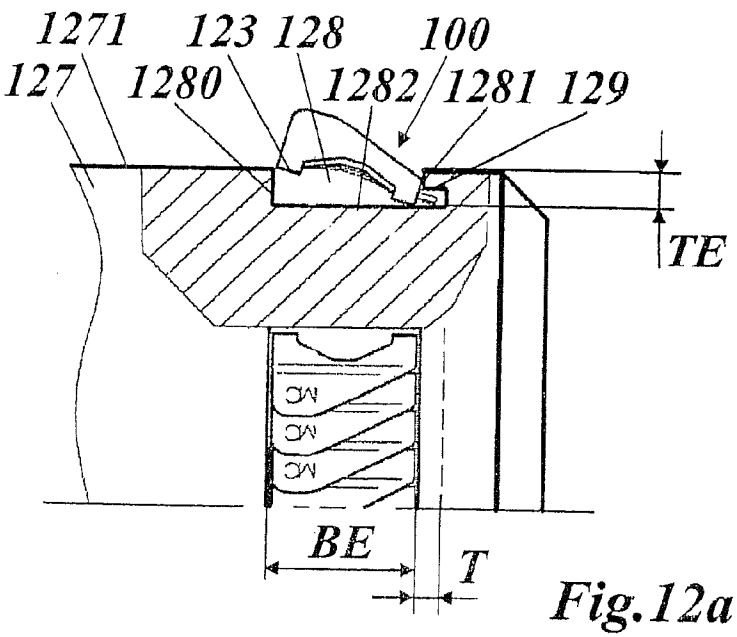

FIGS. 12*a* and 12*b* show a cylindrical plug 127 and a socket 126. In this case, the cylindrical plug 127 is equipped with an L-shaped groove according to the invention, which comprises a recess 128 with a single undercut 129, for accommodating a contact element cited in this application. As an alternative, other contact elements which are known, for example, from the prior art can likewise be inserted into the recess 128 according to the invention.

That is to say, in a general formulation, that the contact element 100 has a guide lug 115 which protrudes transversely outward, wherein the guide lug 115 protrudes beyond the web element 117, in particular on one side, and wherein the contact element 100 is guided in a single lateral undercut 129 in the recess 128 by the guide lug 115. In this case, the contact element 100 is situated in the recess 128, wherein the guide lug 115 projects into the undercut 129.

FIGS. 12*a* and 12*b* show a partially sectioned illustration of the region in which the recess 128 is arranged, wherein the section runs centrally through the cylindrical plug 127. The recess 128 extends from the surface 1271 of the cylindrical plug 127 into the latter. The recess 128 is bounded by a first side wall 1280, a second side wall 1281 and a bearing surface 1282. The recess 128 has a rectangular cross section which has a depth TE and a width BE. The depth TE is selected such that parts of the web elements 117 protrude beyond the surface 1271 of the plug 127.

Furthermore, the recess 128 has only one undercut 129 which extends into one of the side walls 1280, 1281. The undercut 129 is therefore arranged on one side of the recess 128. In the present exemplary embodiment, the undercut 129 extends into the second side wall 1281. In this case, the undercut is arranged in such a way that it extends into the corresponding side wall 1280, 1281 in the direction of the bearing surface 1282, wherein the undercut 129 is advantageously essentially aligned with the bearing surface 1282. The undercut 129 has a depth T, as seen from the side wall. The depth T preferably corresponds approximately to the length L of the protruding part of the guide lugs 115. The resulting groove can also be called L-shaped on account of the arrangement of the undercut 129.

FIG. 12*a* illustrates how a contact element, in this case contact element 100, is inserted into the L-groove or into the recess 128 with the undercut 129 according to the invention. In this case, the contact element 100 is inserted into the recess 128 in an inclined manner such that parts of the protruding guide lugs 115 can project into the undercut 129. The contact element 100 is then pushed in the direction of the undercut 129 until parts of the contact element reach the second side wall 1281. In a further step, the contact element 100 can then be pushed in the direction of the bearing surface 1282. As soon as the contact element 100 is situated in the recess 128 and in the undercut 129, said contact element is fully installed. This state is shown in FIG. 12*b*.

FIG. 12*b* likewise shows how the plug 127 can be inserted into the socket 126. If there is play between the contact element 100 and the recess 128 with the undercut 129, the contact element 100 is pushed in the direction of the first side surface 1280 which acts as a stop in this case. The width BE of the recess 128 is accordingly to be dimensioned such that it is in no way wider than the maximum width B of the contact element 100. This ensures that the contact element 100 is not released from being securely accommodated by the recess.

It can also be seen from FIG. 12*b* that the undercut can be arranged in the first side wall 1280 as an alternative. If the contact element is to be installed in the same direction, that is to say such that the fin tip 21 is to be arranged at the rear in the plugging direction, the guide lugs 115 would than have to extend beyond the other side of the web element 117 or of the clamping foot 119.

A first advantage of the described recess 128 with the undercut 129 is the fact that the contact element 100 can be mechanically held in the recess by means of its inherent stress and by the guide lug 115.

The recess 128 according to the invention with the undercut 129 or the L-shaped groove is particularly advantageous since no insertion path has to be provided through which the contact element can be inserted into the groove. As a result, the groove for accommodating the contact element 100 can be produced in an essentially simpler and therefore more rapid and more cost-effective manner. Furthermore, insertion of the contact element 100 is simpler than in the case of other grooves. Furthermore, securing elements, such as securing rings etc., can also be dispensed with.

As an alternative to the above-described embodiment in which the recess 128 with an undercut 129 has been shown on a cylindrical plug, the recess 128 according to the invention with the undercut 129 can also be used with other elements.

Figure 13B:
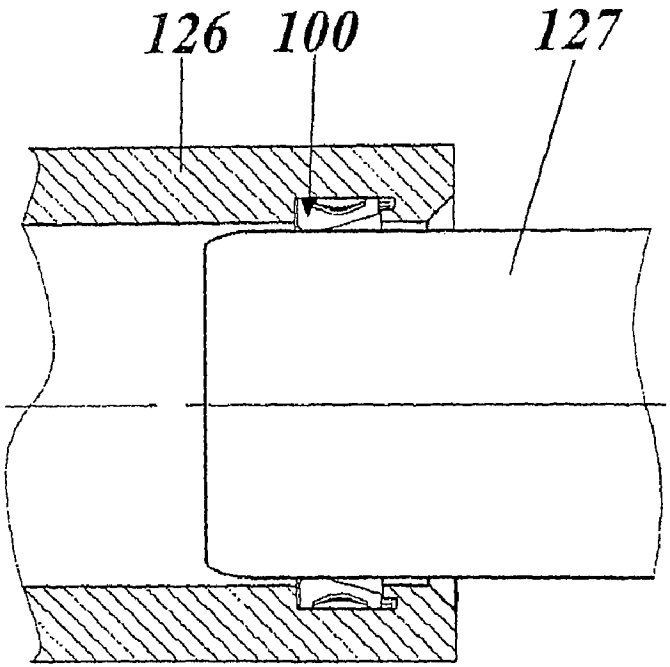
FIG. 13 shows, in two subfigures 13(*a*) and 13(*b*), various details and views of a contact element, which is or is to be installed, in a socket.
Figure 13A:
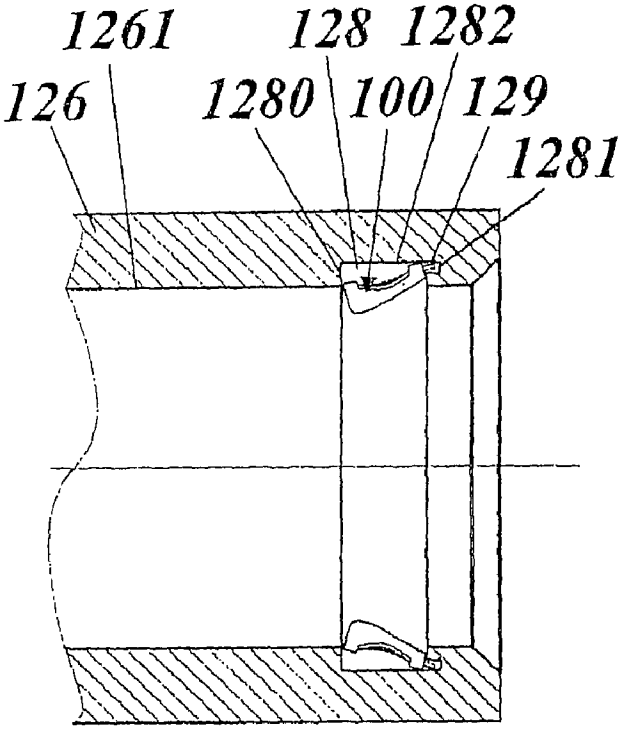

FIGS. 13*a* and 13*b* show the arrangement of the recess 128 with an undercut 129 in a socket 126. Identical parts are provided with identical reference symbols. In this case, the recess 128 is arranged such that it is recessed in the surface 1261 of the socket. The L-shaped groove can be produced in a particularly simple and cost-effective manner in this case too.

In further embodiments, it is also feasible for the L-shaped groove, that is to say the recess 128 with the undercut 129, to be arranged not only in a cylindrical surface but also in a flat surface.

In a further exemplary embodiment, it is feasible, for example, to adapt the contact elements shown in figures and 6, in particular the contact elements 30, 30' which are arranged in a double row, in such a way that they likewise have only one individual guide lug which protrudes beyond the clamping foot or beyond the web element on one side.

LIST OF REFERENCE SYMBOLS

10, 10', 100 Contact element (contact lamella)
11, 31, 111 Carrier strip
12, 112 Web
13, 14, 113, 114 Spring arm
15, 115 Guide lug
16 Hole
17, 117 Web element
18, 19, 118, 119 Clamping foot
20, 120 Contact fin
21, 40, 44, 121 Fin tip
22, 41, 45, 122 Incline
23, 123 Contact lug
24 Bend
25 Rounded portion
26, 126 Socket
1261 Surface of the socket
27, 127 Plug
1271 Surface of the plug
28, 128 Recess
1280 First side wall
1281 Second side wall
1282 Bearing surface
29, 129 Undercut
30, 30' Contact element (contact lamella)
32, 32' Web
33 Central connection
34, 34' Spring arm
35, 35' Spring arm
36, 37 Web element
38, 39 Clamping foot
42, 43 Clamping foot
46 Socket
47 Plug
48, 49 Rounded portion
α Angle
h1, . . . , h3 Height
M1, M2, M3 Center plane (web elements)
ST1, ST2 Prior art

The invention claimed is:

1. A contact element having a spring-elastic carrier strip, which extends in a longitudinal direction and which defines a plane, and a plurality of web elements, which are arranged one behind the other in the longitudinal direction of the carrier strip and are attached to the carrier strip resiliently compressable in a direction perpendicular to said plane of the carrier strip, wherein said web elements are adapted to establish electrical contact between two opposite surfaces and wherein the web elements are formed in an asymmetrical manner relative to a center plane which runs in the longitudinal direction of the carrier strip, wherein the web elements each have two clamping feet which are spaced apart from one another transverse to the longitudinal direction of the carrier strip and by means of which said web elements are attached to the carrier strip, and by means of which said web elements make electrical contact with one of the two opposite surfaces, and wherein the web elements each have a triangular contact fin which is connected to the clamping feet and of which the fin tip is arranged on one side of the center plane and makes electrical contact with the other of the two opposite surfaces.

2. The contact element as claimed in claim 1, wherein the carrier strip for the web elements which are arranged one behind the other in the longitudinal direction of the carrier strip has, in each case, two spring arms which project transverse to opposite directions from a web which extends in the longitudinal direction of the carrier strip, and which act as torsion springs, and which have attached to their free ends the respective web element by means of said clamping feet, and wherein the web elements which are arranged one behind the other in the longitudinal direction of the carrier strip are arranged so as to overlap.

3. The contact element as claimed in claim 1, wherein each contact fin essentially has the shape of a right-angled triangle in which the contact feet are arranged at the ends of one leg, and the fin tip is formed by the other leg and the hypotenuse.

4. The contact element as claimed in claim 1, wherein, in the region of the clamping feet, the web elements in each case surround the carrier strip or spring arms by way of a contact lug in a clamping manner.

5. The contact element as claimed in claim 1, wherein, in addition to the clamping-type attachment of the web elements to the carrier strip or the spring arms, an interlocking connection is provided between the carrier strip or spring arms and the clamping feet.

6. The contact element as claimed in claim 1, wherein, in order to establish an interlocking connection, holes are made in the carrier strip or the spring arms, the clamping feet engaging in said holes by way of a corresponding embossment.

7. The contact element as claimed in claim 1, wherein guide lugs which protrude laterally beyond the clamping feet are integrally formed at the free ends of spring arms.

8. The contact element as claimed in claim 1, wherein a guide lug is integrally formed at the free end of a spring arm, said guide lug protruding laterally beyond a clamping foot.

9. The contact element of claim 8, wherein said guide lug protrudes laterally beyond the clamping foot on only one side.

10. The contact element as claimed in claim 1, wherein the contact element has only one row of web elements which are arranged one behind the other in the longitudinal direction of the carrier strip, and the associated carrier strip correspondingly comprises only one web which extends in the longitudinal direction of the carrier strip and runs in the center of the carrier strip, having two spring arms which project transversely in opposite directions and act as torsion springs.

11. The contact element as claimed in claim 1, wherein the contact element has two parallel rows of web elements which are arranged one behind the other in the longitudinal direction of the carrier strip, wherein the associated carrier strip correspondingly comprises two webs which extend in parallel in the longitudinal direction of the carrier strip and in each case have two spring arms which project from said webs transversely in opposite directions and act as torsion springs, and wherein the spring arms which project inward from the two webs are connected to one another in pairs at the ends by means of a central connection.

12. The contact element as claimed in claim 1, wherein the central connection is designed such that the web element which is in each case at the rear in the plugging direction is resiliently precompressed during the plugging process and independently establishes electrical contact between the two opposite surfaces in the fully plugged-in state.

13. The contact element as claimed in claim 11, wherein the web elements of the two parallel rows are designed and arranged so as to form a mirror image with respect to a center plane which is situated between the rows.

14. The contact element as claimed in claim 11, wherein the web elements each have two clamping feet which are spaced apart from one another transverse to the longitudinal direction of the carrier strip and by means of which said web elements are attached to the carrier strip, and by means of which said web elements make electrical contact with one of the two opposite surfaces, and wherein the web elements each have triangular contact fins which are connected to the clamping feet and of which the fin tips are arranged on both sides and in the immediate vicinity of the center plane which is situated between the rows and make electrical contact with the other of the two opposite surfaces.

15. Plug and socket connection which comprises a contact element having a spring-elastic carrier strip, which extends in a longitudinal direction and which defines a plane, and a plurality of web elements, which are arranged one behind the other in the longitudinal direction of the carrier strip and are attached to the carrier strip resiliently compressable in a direction perpendicular to said plane of the carrier strip, wherein said web elements are adapted to establish electrical contact between two opposite surfaces and wherein the web elements are formed in an asymmetrical manner relative to a center plane which runs in the longitudinal direction of the carrier strip, wherein the web elements each have two clamping feet which are spaced apart from one another transverse to the longitudinal direction of the carrier strip and by means of which said web elements are attached to the carrier strip, and by means of which said web elements make electrical contact with one of the two opposite surfaces, and wherein the web elements each have a triangular contact fin which is connected to the clamping feet and of which the fin tip is arranged on one side of the center plane and makes electrical contact with the other of the two opposite surfaces and wherein the contact element is arranged in a recess on the outside of the plug or on the inside of the socket in such a way that the fin tip is arranged at the rear in the plugging direction.

16. Plug and socket connection claimed in claim 15, wherein the contact element has guide lugs which protrude transversely outward, and is guided in lateral undercuts in the recess by the guide lugs.

17. Plug and socket connection claimed in claim 15, wherein the contact element has guide lugs which protrude transversely outward, wherein the guide lugs protrude beyond the web element, and wherein the contact element is guided in a single lateral undercut in the recess by the guide lugs.

18. Plug and socket connection claimed in claim 15, wherein the contact element has guide lugs which protrude transversely outward, wherein the guide lugs protrude beyond the web element on one side, and wherein the contact element is guided in a single lateral undercut in the recess by the guide lugs.

19. Plug and socket connection which comprises contact element having a spring-elastic carrier strip, which extends in a longitudinal direction and which defines a plane, and a plurality of web elements, which are arranged one behind the other in the longitudinal direction of the carrier strip and are attached to the carrier strip resiliently compressable in a direction perpendicular to said plane of the carrier strip, wherein said web elements are adapted to establish electrical contact between two opposite surfaces and wherein the web elements are formed in an asymmetrical manner relative to a center plane which runs in the longitudinal direction of the carrier strip, wherein the web elements each have two clamping feet which are spaced apart from one another transverse to the longitudinal direction of the carrier strip and by means of which said web elements are attached to the carrier strip, and by means of which said web elements make electrical contact with one of the two opposite surfaces, and wherein the web elements each have a triangular contact fin which is connected to the clamping feet and of which the fin tip is arranged on one side of the center plane and makes electrical contact with the other of the two opposite surfaces and wherein the contact element is arranged in a recess on the outside of the plug or on the inside of the socket.

20. A contact element having a spring-elastic carrier strip, which extends in a longitudinal direction and which defines a plane, and a plurality of web elements, which are arranged one behind the other in the longitudinal direction of the carrier strip and are attached to the carrier strip resiliently compressable in a direction perpendicular to said plane of the carrier strip, wherein said web elements are adapted to establish electrical contact between two opposite surfaces, wherein the web elements are formed in an asymmetrical manner relative to a center plane which runs in the longitudinal direction of the carrier strip, and wherein the web elements comprise a fin tip that is arranged on one side of said center plane, wherein web elements comprise contact fins which essentially have the shape of a right-angled triangle which is in connection by two legs with the carrier strip.

21. The contact element as claimed in claim 20, wherein wherein the web elements are arranged so as to overlap each other.

22. The contact element as claimed in claim 20, wherein the contact element has only one row of web elements which are arranged one behind the other in the longitudinal direction of the carrier strip.

23. The contact element as claimed in claim 20, wherein the contact element has two parallel rows of web elements which are arranged one behind the other in the longitudinal direction of the carrier strip.

24. The contact element as claimed in claim 20, wherein the web elements of the two parallel rows are designed and arranged so as to form a mirror image with respect to a center plane which is situated between the rows.

* * * * *